US005439410A

United States Patent [19]

Larsson

[11] Patent Number: 5,439,410

[45] Date of Patent: Aug. 8, 1995

[54] POLISHING DRUM

[75] Inventor: Svante Larsson, Umea

[73] Assignee: SL Innovation AB, Umea

[21] Appl. No.: 179,928

[22] Filed: Jan. 11, 1994

[30] Foreign Application Priority Data

Jan. 12, 1993 [SE] Sweden ..... 9300055

[51] Int. Cl.[6] ..... B24B 9/18; B24D 9/04

[52] U.S. Cl. ..... 451/28; 451/500

[58] Field of Search ..... 51/281 R, 368, 367, 51/364, 370; 451/28, 500, 499, 496, 502

[56] References Cited

U.S. PATENT DOCUMENTS

| | | | |
|---|---|---|---|
| 507,508 | 10/1893 | Stubbe | 51/368 |
| 946,920 | 1/1910 | Nichols | 451/499 |
| 950,527 | 3/1910 | Avram | 451/499 |
| 2,218,538 | 10/1940 | Knowlton | 451/500 |
| 2,475,555 | 7/1949 | Saalinger | 51/368 |
| 2,654,192 | 10/1953 | Lynch | 51/368 |
| 2,727,463 | 12/1955 | Foster, Jr. | 451/500 |
| 3,029,567 | 4/1962 | Gregora | 451/500 |

*Primary Examiner*—Robert A. Rose

*Attorney, Agent, or Firm*—Nils H. Ljungman & Associates

[57] ABSTRACT

The invention relates to a polishing drum (1) which is intended particularly for polishing the edge surfaces and outer surfaces of straight and curved workpieces (101) and which carries an abrasive sheet (70) on a center cylinder (2) and is intended to be driven for rotation by a drive means (100). The polishing drum includes an elastic sleeve (60) or cloth which can be tensioned around the cylinder (2) and which forms an underlying supportive surface for the abrasive sheet (70). The center cylinder (2) has an axially extending slot (6) and means (40, 61) for tensioning the elastic sleeve (60) or cloth and the abrasive sheet (70) are provided inwardly of the slot (6).

18 Claims, 2 Drawing Sheets

POLISHING DRUM

The present invention relates to a polishing drum which is intended particularly for polishing the edge surfaces and outer surfaces of straight and curved workpieces and which carries an abrasive sheet on its outer cylindrical surface and is intended to be driven for rotation by a drive means. By polishing is meant all manner of surface abrasion treatment, including rough polishing, dry fining and finishing.

The polishing drums at present available are normally of two different types. One type is based on the principle of an expandable drum onto which abrasive sleeves are fitted, whereas the other type is based on the principle of a drum onto which abrasive paper or abrasive cloth is fastened eccentrically. Both of these types of polishing drum are encumbered with drawbacks however.

The expandable drum builds on the use of expensive abrasive sleeves. Furthermore this type of polishing drum is not suitable for polishing surfaces that shall be flat in the direction of the long axis of the drum since the softness of the drum results in rounded corners, which is not always acceptable. The abrasive sleeves also tend to slip against the drum when the polishing friction generated exceeds the friction acting between sleeve and drum.

The type of polishing drum that is based on eccentric locking of an abrasive paper to the drum surface is often comprised of an inner and an outer sleeve, where the outer sleeve is internally eccentric and the inner sleeve is externally eccentric. The abrasive sheet is inserted into an axial slot provided in the outer sleeve and is locked in the slot with the aid of the eccentric sleeves. This type of polishing drum does not stretch the abrasive paper, but merely fastens the paper securely to the drum. As a result the paper is not supported adequately from beneath and will become torn in use, unless the abrasive paper is tensioned effectively when fitting the paper to the drum. This type of polishing drum can only be used to polish surfaces that are perfectly flat in relation to the direction of the longitudinal axis of the drum. Furthermore, the fact that the mutual positions of rotation of the eccentric sleeves will vary in dependence on the thickness of the abrasive paper used problems of imbalance are encountered. One big economical advantage with this type of polishing drum, however, is that it is possible to cut and use abrasive paper direct from an abrasive paper reel.

The object of the invention is to provide a highly efficient and attractive polishing drum with which many of the aforesaid drawbacks and problems are eliminated. This object is achieved with a polishing drum that has the characteristic features set forth in the following claims.

Among the numerous advantages afforded by the inventive polishing drum is that it can be used together with abrasive paper that is cut directly from an abrasive paper reel, which is highly beneficial from the point of view of economy. Furthermore, the problem of paper fracture has been effectively eliminated by constantly supporting the paper from beneath. By changing the tension in the abrasive paper it is possible to adapt the polishing properties of the polishing drum in a manner which will allow surfaces that are to be flat in the long axis direction of the drum and also surfaces that are to be rounded in said long axis direction to be polished.

The inventive drum also effectively eliminates the problem of imbalance.

The invention will now be described in more detail with reference to exemplifying embodiments thereof and also with reference to the accompanying drawings, in which FIG. 1 is a perspective illustration of the inventive polishing drum when used to polish a workpiece;

Figure 1:
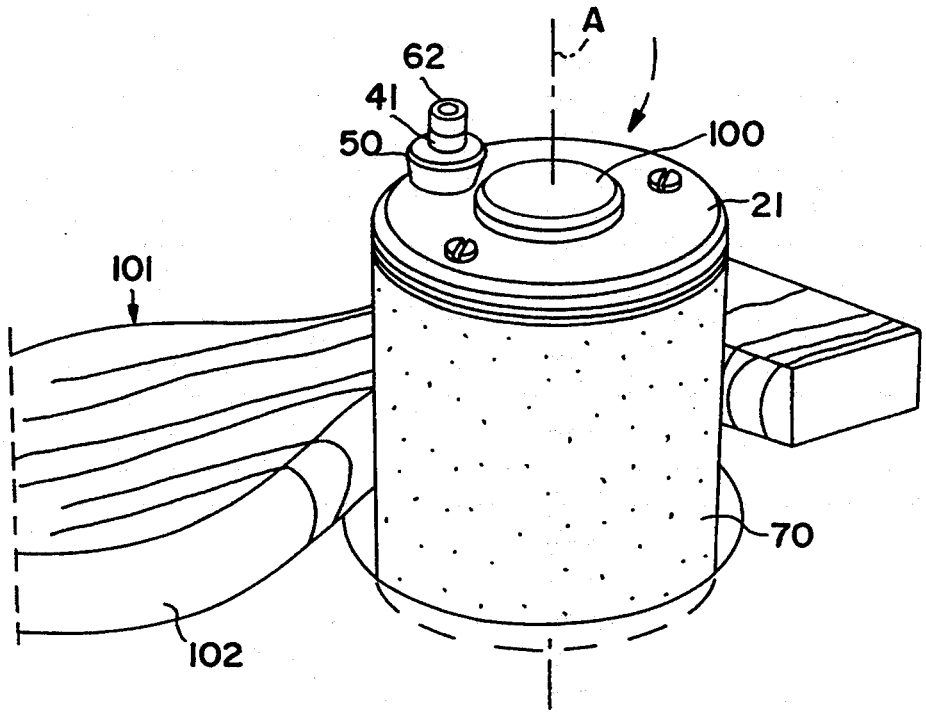
Figure 3:
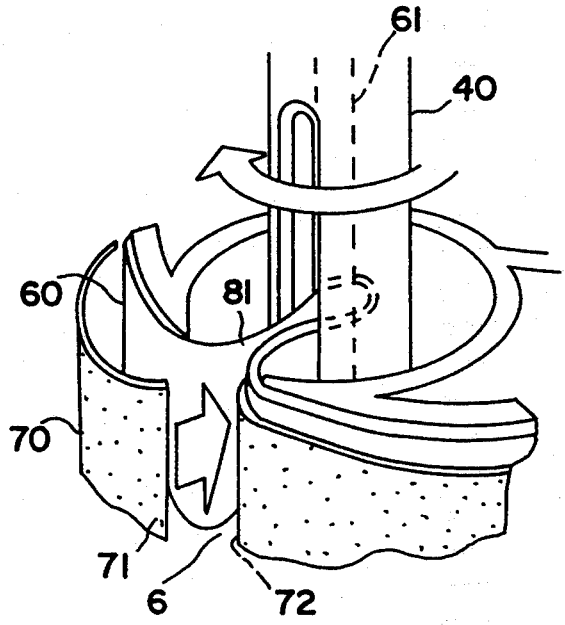
FIG. 3 illustrates diagrammatically the principle on which the tensioning mechanism works.

The illustrated inventive polishing drum 1 comprises a centre cylinder 2, for instance an extruded aluminium profile. The cylinder 2 includes an inner tubular member 3 which is located centrally in the cylinder and which has a central bore 4. The bore 4 is intended to receive a spindle 100 of a machine, such as a milling machine, a lathe or a drilling machine, such as to lock the drum to the machine.

The cylinder 2 also includes an outer tubular member 5 which is concentric with the inner tubular member 3. Provided longitudinally along the outer tubular member 5 is a slot 6 and a tubular cavity 7 is located radially inwards of the slot, the walls 8, 9 of which cavity are connected to the central inner tubular member 3. Two stiffening ribs 10, 11 extend axially along the cylinder, between the inner tubular member 3 and the outer tubular member 5. The cylinder 2 is also provided with two diametrically opposed and longitudinally extending screw-threaded lugs 12, 13.

The drum 1 includes a bottom end wall 20 and a top end wall 21, each of which is provided with a centre hole 22, the diameter of which coincides with the diameter of the centre bore 4 in the inner tubular member 3. The outer diameter of respective end walls 20, 21 coincides with the outer diameter of the outer tubular member 5. Each of the end walls 20, 21 has mounted on the surface thereof that faces inwardly into the cylinder 2 a shoulder 23 which fits into and is guided in the cavity 7 in the cylinder 2. The shoulder 23 on the bottom end-wall 20 is provided with a blind hole 24, whereas the shoulder 23 on the top end-wall 21 is provided with a through-penetrating hole 25. The end walls 20, 21 also include guide edges 26, 27 which are adapted to cavities in the centre cylinder 2 and which function together with the shoulders 23 to guide the end walls 20, 21 relative to the cylinder 2. The end walls 20, 21 are also each provided with holes 28, in a location which coincides with the location of respective screw lugs 12, 13. The top end-wall 21 is also provided with a plurality of holes 29, whose function will be explained further on. The end walls 20, 21 are secured to the cylinder 2 by means of screws which pass through the holes 28 and screw into the threaded lugs 12, 13.

The cavity 7 accommodates a twist tube 40, the bottom end of which rests in and is guided by the blind hole 24 in the bottom end-wall 20 and the top end 41 of which projects out through the hole 25 in the top end-wall 21. The twist tube 40 is provided with a slot 42 which extends axially along the tube and terminates in the proximity of both ends of the tube. Mounted on the upper end 41 of the twist tube 40 is a locking ring 43 which is held fixed in an external circular groove in the twist tube 40. The upper surface of the locking ring 43 abuts the undersurface of the shoulder 23 on the top end-wall 21 at the same time as the lower end of the twist tube 40 is guided in the blind hole 24 in the shoulder 23 on the bottom end-wall 20. In this way, the twist tube 40 is fixed and mounted for rotation about its longitudinal axis relative to the cylinder 2 while the upper end 41 extends out through the top end-wall 21.

A knob 50 provided with a centre hole 51 is arranged at the upper end 41 of the twist tube 40, said upper end 41 projecting out through the hole 51. That surface of the knob 50 which faces towards the top end-wall 21 has mounted thereon a number of pins 52 whose positions and distribution coincide with the pattern formed by the holes 29 in the top end-wall 21. The knob 50 is held against rotation on the twist tube 40 by means of a grub screw 54 which is screwed into a threaded hole 55 in the knob 50 and into the upper end of the slot 42 so as to be in axial sliding engagement therewith. The knob 50 thus has a limited amount of movement along the twist tube 40, so that the pins 52 can be moved into and out of the holes 29. This enables the knob 50 to be lifted so as to release engagement of the pins 52 with the holes 29 temporarily, whereafter the twist tube 40 can be turned to a desired position with the aid of the knob 50 and then fixed in said position, by lowering the knob 50 and again bringing the pins 52 into engagement with the holes 29. The smallest stepping increment of this rotation is determined by the number of pins 52 and holes 29 provided.

An elastic sleeve 60, which may be made of rubber or a plastic material for instance, is placed around the outside of the cylinder 2 and projects into the slot 6 and in through the slot 42 in the twist tube 40. The sleeve 60 passes around a locking pin 61 fixedly mounted in the twist tube 40, so as to lock the sleeve firmly relative to said tube. The pin 61 is held fixed in the tube 40 by means of a screw 62 which meshes with a corresponding screw-thread in the tube 40 and blocks the upper end 41 of the tube 40. The locking pin 61 extends between the blind hole 24 and the screw 62. The elastic sleeve 60 hangs loosely around the cylinder 2 when the twist tube 40 is in its starting or idle position.

The described polishing drum is used and operates in the following manner.

It is assumed that the twist tube 40 is in its idle position and that the sleeve 60 hangs loosely around the cylinder 2. An abrasive paper sheet 70, for instance sand paper or emery cloth or like abrasive, is cut to size and placed around the elastic sleeve 60 with the ends 71, 72 of the paper sheet 70 inserted into the gap 81 which is formed by the sleeve 60 in the region thereof immediately outside the twist tube 40. The abrasive sheet 70 is then tensioned around the cylinder 2, by lifting the knob 50, so as to remove the pins 52 from the holes 29, and turning the knob so as to wind part of the sleeve 60 onto the outer surface of the tube 40 and thereby tension the sleeve around the cylinder 2. The ends 71, 72 of the abrasive sheet 70 will accompany the sleeve 60 as it is drawn into the slot 6, therewith also stretching the abrasive sheet 70 around the cylinder 2. The knob 50 is turned until the desired tension is obtained in the sleeve 60 and the abrasive sheet 70, whereafter the twist tube 40 is locked by pushing down the knob 50 so that the pins 52 enter respective holes 29.

The extend to which the sleeve and the abrasive sheet are tensioned, and therewith the polishing properties of the polishing drum, can be varied as required. Simultaneous stretching of the sleeve 60 and the abrasive sheet 70 is thus achieved in conjunction with turning the twist tube 40 in the appropriate direction.

When the polishing drum 1 provided with an abrasive paper 70 of required quality is fitted to the spindle 100 of a machine, the drum 1 can be used to polish (as hereinbefore defined) the edge surfaces and outer surfaces of straight and curved workpieces, for instance the surfaces of the jig-sawn wooden structural member 101 shown in FIG. 1 with the abrasive paper 70 carried by the drum 1 in working engagement with an edge surface 102 of the member 101, said drum 1 being rotated by the spindle 100 about its longitudinal axis A.

As the drum 1 rotates, the elastic sleeve 60 will expand outwardly against the abrasive paper 70. The abrasive paper 70 will therefore always be in tension and because the paper is supported from beneath by the sleeve 60 as it expands during rotation of the drum 1 the paper will be imparted a unique strength. The elasticity of the polishing drum can be varied from a fully rigid state to an optimally soft or pliant state, by appropriate changes to the tension in the abrasive paper. The elastic tension induced contributes towards improving the polishing efficiency of the drum 1 and the durability of the abrasive paper 70.

Consumed abrasive paper 70 is removed by lifting the knob 50 to remove the pins 52 from the holes 29 and then turning the knob 50 so as unwind the sleeve 60 from around the twist tube 40, therewith enabling the abrasive paper 70 to be removed from the drum 1 and a fresh strip of abrasive paper fitted to the drum, in the manner described.

It will be understood that certain changes and modifications can be made to the described and illustrated polishing drum. For instance, the elastic sleeve 60 can be replaced with an elastic cloth whose ends are connected to the twist tube 40.

It will also be understood that the form taken by the attachment means 4 can be adapted to suit the actual machine concerned.

The weight of the centre cylinder 2 may be distributed so as to balance the polishing drum 1, although drum imbalance may of course be eliminated in other ways.

The invention is therefore not restricted to the described and illustrated embodiment thereof, since changes and modifications can be made within the scope of the following claims.

The phrase "polishing drum" may also be interpreted to include a sanding drum. In addition, the word "polishing" may also be interpreted to include sanding. Further, the phrase "surface abrasion treatment" may also be interpreted to include sanding, in addition to the other treatments mentioned.

Figure 2:
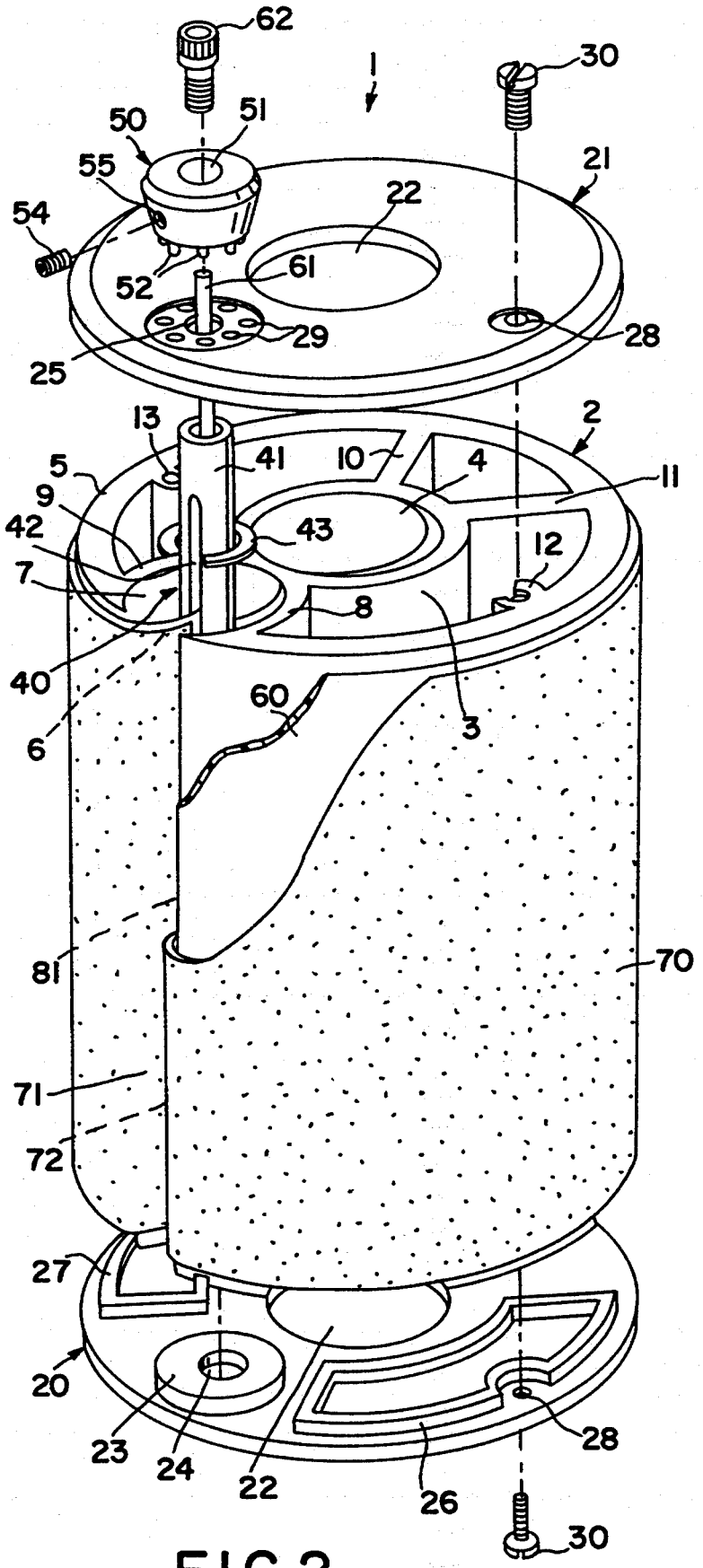
FIG. 2 is an exploded view of the inventive polishing drum.

Referring back to FIG. 2, the cylinder 2 could include an inner tubular member 3 which could be disposed concentrically within the cylinder 2. The inner tubular member 3 could extend in an axial direction through the entire length of the inside of the cylinder 2. In a similar manner, the bore 4 could also extend in an axial direction through the entire length of the inside of the cylinder 2.

The bore 4 could be configured to receive a spindle or similar structure of a machine, such as a lathe, a milling machine, or a drilling machine or drill press. Alternatively, the inner tubular member 3 could have a central projecting rod. This projecting rod could then be clamped or inserted into a chuck of a drill press, a lathe, or some other type of machine which features a rotating drive mechanism.

The drum 1 typically includes a top end wall 21 or cover and a bottom end wall 20 or cover. Alternatively, the drum 1 could be constructed without the use of end walls or covers. In this alternative embodiment, the shoulders 23 could be mounted directly on the top and bottom surfaces of the drum 1. Further, in this embodiment the knob 50, twist tube 41, and screw 62 could be mounted directly onto the top surface of the drum 1, instead of on the top end wall 21. The holes 29 would therefore preferably have to be located on the top of the drum 1, instead of in the top end wall 21.

The elastic sleeve 60 could be placed around the outside of the cylinder 2 and could project into the slot 6 and in through the slot 42 in the twist tube 40. As the drum 1 rotates, the elastic sleeve could expand outwardly preferably due to centrifugal force. Alternatively, the drum 1 could possibly even be used without an elastic sleeve 60. In this possible embodiment, the abrasive paper 70 could be placed around the outside of the cylinder 2 directly and could then project into the slot 6 and in through the slot 42 in the twist tube 40. Thus, the abrasive paper 70 could be tensioned in a similar way as the sleeve 60 could be tensioned in the previous embodiment.

The end walls 20 and 21 could each have a shoulder 23. The shoulder 23 preferably disposed on the top end wall 21 is not shown due to the orientation of the polishing drum 1 in FIG. 2. In addition, the end walls 20 and 21 could also include raised guide edges 26 and 27. The guide edges 26 and 27 could be disposed on the surfaces of the end walls 20 and 21 which face inwardly into the cylinder 2. The guide edges 26 and 27 of the top end wall 21 are also not shown due to the orientation of the polishing drum in FIG. 2. Further, the end walls 20 and 21 could also have holes 28, which holes are preferably disposed in the end walls 20 and 21. The holes 28 are preferably disposed in a location which would coincide with screw lugs 12 and 13. The screw lugs 12 and 13 could be disposed along the inner circumference of the outer tubular member 5. The screw lugs 12, 13 could extend in an axial direction along the entire length of the outer tubular member 5. Alternatively, the screw lugs 12, 13 may extend axially along only an end portions of the inner circumference of the outer tubular member 5. The screw lugs 12 and 13 which could be disposed on the bottom end of the polishing drum 1 so as receive screws inserted into the bottom end wall 20 are not shown due to the orientation of the polishing drum in FIG. 2.

One feature of the invention resides broadly in the polishing drum which is intended particularly for polishing the edge surfaces and outer surfaces of straight and curved workpieces and which carries an abrasive sheet on a center cylinder and is intended to be driven for rotation by a drive means, characterized in that the polishing drum includes an elastic sleeve or cloth which could be tensioned around the cylinder and which forms an underlying supportive surface for the abrasive sheet; in that the center cylinder has an axially extending slot; and in that the drum includes inwardly of the slot means for commonly tensioning the elastic sleeve or cloth and the abrasive sheet.

Another feature of the invention resides broadly in the drum, characterized in that the tensioning means includes a twist tube to which the elastic sleeve or the elastic cloth is fastened.

Still another feature of the invention resides broadly in the drum, characterized in that the tensioning means includes means for fixating the twist tube in different positions of rotation.

Yet another feature of the invention resides broadly in the drum, characterized in that the drum has a center bore by means of which the drum is secured to the drive means.

Types of sanding or polishing drums or devices are disclosed in the following patents: U.S. Pat. No. 4,471,582 to Neary on Sep. 18, 1984, entitled "Sanding Drum"; U.S. Pat. No. 5,094,037 to Hakomori et al. on Mar. 10, 1978, entitled "Edge Polisher"; U.S. Pat. No. 4,080,714 to Emerson on Mar. 28, 1978, entitled "Flexible Polishing Drum Segment and Method of Making and Mounting Same"; and U.S. Pat. No. 4,720,940 to Green on Jan. 26, 1988, entitled "Rotary Drum Sander".

In addition, some types of devices which the present invention might be used in conjunction with are disclosed in the following patents: U.S. Pat. No. 5,207,134 to Wakatsuki on May 4, 1993, entitled "Automatic Precision Lathe"; U.S. Pat. No. 5,186,087 to McCormack on Feb. 16, 1993, entitled "Wood Lathe"; U.S. Pat. No. 4,787,794 to Guthrie on Nov. 29, 1988, entitled "Drill Press with Quick Adjusting Stop Nut Assembly"; U.S. Pat. No. 4,468,159 to Oster on Aug. 28, 1984, entitled "Drill Press and Stand"; U.S. Pat. No. 4,830,069 to Milyard on May 16, 1989, entitled "Woodworking Machine"; U.S. Pat. No. 5,025,539 to Stark on Jun. 25, 1991, entitled "Drilling and Milling Machine"; and U.S. Pat. No. 5,054,975 to Wawrzyniak et al. on Oct. 8, 1991, entitled "Milling Machine with Mill Head Having Retractable Return".

All, or substantially all, of the components and methods of the various embodiments may be used with at least one embodiment or all of the embodiments, if any, described herein.

All of the patents, patent applications and publications recited herein, and in the Declaration attached hereto, are hereby incorporated by reference as if set forth in their entirety herein.

The corresponding foreign patent publication application, namely, Swedish Patent Application No. SE 9300055-2, filed on Jan. 12, 1993, having inventor Svante Larsson, and the corresponding Swedish Laid Open Patent Application and the corresponding Swedish Patent, as well as their published equivalents, and other equivalents or corresponding applications, if any, in corresponding cases in Sweden and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings in their entirety, including all dimensions, proportions and/or shapes in at least one embodiment of the invention, are accurate and to scale and are hereby included by in this specification.

The invention as described hereinabove in the context of the preferred embodiments is not to be taken as limited to all of the provided details thereof, since modifications and variations thereof may be made without departing from the spirit and scope of the invention.

I claim:

1. A polishing drum which is intended particularly for polishing the edge surfaces and outer surfaces of straight and curved workpieces, and which carries an abrasive sheet on a center cylinder, and is intended to be driven for rotation by a drive means, wherein the polishing drum includes a lining which can be tensioned around the cylinder and which forms an underlying supportive surface for the abrasive sheet; in that the center cylinder has an axially extending slot; and in that the drum includes, inwardly of the slot, means for commonly tensioning the lining and the abrasive sheet; wherein the tensioning means includes a twist tube to which the lining is fastened.

2. A drum according to claim 1, wherein the tensioning means include means for fixating the twist tube in different positions of rotation.

3. A method of polishing the edge surfaces and outer surfaces of straight and curved workpieces which will include a polishing drum, said method comprising the steps of:

providing an abrasive sheet;
providing a center cylinder having an external cylindrical surface;
providing a drive means for rotating the center cylinder;
providing a lining comprising a sheet material and having an external surface;
disposing the lining around the external cylindrical surface of the center cylinder;
disposing the abrasive sheet around the center cylinder and around the external surface of the lining;
configuring the lining to form a supportive surface for the abrasive sheet;
providing an axially extending slot in the center cylinder;
providing means for tensioning the lining along with the abrasive sheet including a twist tube;
disposing the means for tensioning the lining inward from the slot;
attaching the lining to the twist tube of the tensioning means;
providing a means for fixing the twist tube in different positions of rotation;
providing a center bore;
securing the polishing drum to the drive means using the center bore; and
polishing a workpiece.

4. A drum according to claim 1, wherein the drum has a center bore by means of which the drum is secured to the drive means.

5. A drum according to claim 2, wherein the drum has a center bore by means of which the drum is secured to the drive means.

6. The method according to claim 3 wherein:

said step of providing the lining comprises providing at least one of a) and b):
a) an elastic material; and
b) a plastic material;
said method further comprises stretching the lining about the external surface of the center cylinder.

7. The method according to claim 6, further comprising the steps of rotating the center cylinder with the drive means at a speed sufficient to provide centrifugal force for expanding the lining outwardly against the abrasive sheet, and tensioning the abrasive sheet by supporting the abrasive sheet from beneath by the centrifugal force for expanding the lining outwardly against the abrasive sheet, to increase the strength of the abrasive sheet and to minimize fractures of the abrasive sheet.

8. The method according to claim 7, further comprising the step of disposing the lining under at least a substantial portion of the abrasive sheet.

9. The method according to claim 8, further comprising the step of disposing the lining under the entire extent of the abrasive sheet to minimize imbalance in the polishing process.

10. The method according to claim 9 wherein:

said step of providing a center cylinder comprises:
providing a first end and a second end;
disposing the center bore axially within the center cylinder;
providing an inner core disposed concentrically about the center bore;
providing an outer core having an external surface and and internal surface;
disposing the outer core radially away from the inner core and concentrically about the inner core;
configuring the external cylindrical surface of the center cylinder to comprise the external surface of the outer core;
providing at least two webs extending radially from the inner core to the outer core and extending the two webs axially from the first end of the center cylinder to the second end of the center cylinder;
providing an axially extending slot in the center cylinder;
said step of providing the slot comprises providing a part-circular bore extending between the first end of the center cylinder and the second end of the center cylinder;
disposing the part-circular bore at the internal surface of the outer core;
disposing the twist tube in the part-circular bore;
said providing of the twist tube comprises providing slot means extending through at least a portion of the twist tube;
disposing the lining in at least a portion of the slot means;
configuring the drum to comprise a top portion and a bottom portion;
disposing the top portion at the first end of the center cylinder and disposing the bottom portion at the second end of the center cylinder;
said step of providing the top portion comprises providing a substantially circular shape;
said step of providing the bottom portion comprises providing a substantially circular shape;
said step of providing the twist tube comprises providing a first end and a second end;
said step of providing the fixing means comprises:
providing a plurality of holes;
disposing the plurality of holes in the top portion;
said step of providing the plurality of holes comprises providing at least six holes;
providing knob means;
disposing the knob means at the first end of the twist tube;
adjusting the twist tube in the different positions of rotation by means of the knob means;
said step of providing knob means comprises:
providing a plurality of pins corresponding to the plurality of holes;
said step of providing the plurality of pins comprises providing at least six pins;

configuring the plurality of pins to extend into the plurality of holes when the knob means is in a locked position;

providing a center hole;

extending the first end of the twist tube through the center hole;

providing a grub screw;

providing means for receiving the grub screw;

disposing the receiving means radially within the knob means;

disposing the grub screw within the receiving means and extending the grub screw into the slot means of the twist tube;

configuring the grub screw so as to be axially moveable within the slot means of the twist tube to limit the rotational movement of the knob means;

said step of providing the tensioning means comprises:

providing locking pin means;

disposing the locking pin means axially within the twist tube;

locking the lining with respect to the twist tube by means of the locking pin means;

said step of providing the twist tube comprises:

providing a screw thread;

disposing the screw thread within the twist tube at the first end of the twist tube;

said step of providing the knob means comprises:

providing screw means;

disposing the screw means within the center hole and engaging the screw means with the screw thread of the twist tube;

configuring the screw means to fix the locking pin means within the twist tube;

said step of providing the bottom portion of the center cylinder comprises providing means for aligning the tensioning means;

said step of providing aligning means comprises:

providing a substantially circular portion projecting outwardly from the bottom portion;

disposing the circular portion within the part-circular bore;

said step of providing the circular portion comprises providing a blind hole;

disposing the blind hole concentrically within the circular portion;

extending the locking pin means between the screw means and the blind hole of the circular portion;

said step of providing the bottom portion further comprises providing a plurality of projecting portions, the plurality of projecting portions project outwardly from the bottom portion;

said providing of the internal surface of the outer core and the plurality of webs and the inner core comprises defining a plurality of spaces within the center cylinder;

disposing the plurality of projecting portions within corresponding ones of the plurality of spaces within the center cylinder;

said providing of the twist tube comprises:

providing locking ring means;

providing a groove disposed about the external surface of the twist tube;

disposing the locking ring means in the groove of the twist tube;

said step of providing the locking ring means comprises providing a part-circular shape;

providing attaching means for attaching the top and bottom portions to the center cylinder;

said step of providing the center cylinder comprises providing means for receiving the attaching means;

disposing the receiving means of said center cylinder about the circumference of the internal surface of the outer core;

said step of providing the attaching means comprises providing a plurality of screws; and disposing the tensioning means radially inward from the slot means.

11. A drum according to claim 5 wherein said lining comprises an external surface;

said center cylinder has a longitudinal axis; and said center cylinder comprises an external cylindrical surface disposed concentrically about said longitudinal axis.

12. A drum according to claim 11 wherein said lining comprises at least one of a) and b):

a) an elastic material; and b) a plastic material.

13. A drum according to claim 12 wherein said lining is configured to stretch about said external surface of said center cylinder.

14. A drum according to claim 13 wherein said lining is configured to expand by centrifugal force of the rotation of said center cylinder to tension the abrasive sheet by supporting the abrasive sheet from beneath to increase the strength of the abrasive sheet to minimize fractures in the abrasive sheet.

15. A drum according to claim 14 wherein said lining is disposed under at least a substantial portion of the abrasive sheet.

16. A drum according to claim 15 wherein said lining is disposed under the entire extent of the abrasive sheet to minimize imbalance in the polishing process.

17. A drum according to claim 16 wherein said center cylinder comprises:

a first end and a second end disposed axially from one another;

an inner core disposed concentrically about said bore;

an outer core disposed radially away from said inner core and disposed concentrically about said inner core;

said outer core comprises an external surface and an internal surface;

said external cylindrical surface of said center cylinder comprises said external surface of said outer core; and at least two webs extending radially from said inner core to said outer core and said at least two webs extend axially from said first end to said second end.

18. A drum according to claim 17 wherein:

said slot comprises a part-circular bore extending between said first end and said second end;

said part-circular bore is disposed at said internal surface of said outer core;

said twist tube is disposed in said part-circular bore;

said twist tube comprises slot means extending through at least a portion of said twist tube;

said lining is disposed in at least a portion of said slot means;

said drum comprises a top portion and a bottom portion;

said top portion is disposed at said first end of said center cylinder and said bottom portion is disposed at said second end of said center cylinder;

said top portion comprises a substantially circular shape;

said bottom portion comprises a substantially circular shape;

said twist tube comprises a first end and a second end;

said fixating means comprises:

a plurality of holes disposed in said top portion;

said plurality of holes comprises at least six holes;

knob means disposed at said first end of said twist tube for adjusting said twist tube in the different positions of rotation;

said knob means comprises:

a plurality of pins corresponding to said plurality of holes;

said plurality of pins comprising at least six pins;

said plurality of pins are configured to extend into said plurality of holes when said knob means is in a locked position;

a center hole;

said first end of said twist tube extends through said center hole;

a grub screw;

means for receiving said grub screw;

said receiving means disposed radially within said knob means;

said grub screw is disposed within said receiving means and extends into said slot means of said twist tube;

said grub screw is axially moveable within said slot means of said twist tube to limit the rotational movement of said knob means;

said tensioning means comprises:

locking pin means disposed axially within said twist tube for locking said lining with respect to said twist tube;

said twist tube comprises:

a screw thread disposed within said twist tube at said first end of said twist tube; said knob means comprises:

screw means disposed within said center hole and in engagement with said screw thread of said twist tube;

said screw means is configured to fix said locking pin means within said twist tube;

said bottom portion of said center cylinder comprises means for aligning said tensioning means;

said aligning means comprises:

a substantially circular portion projecting outwardly from said bottom portion;

said circular portion is disposed within said part-circular bore;

said circular portion comprises a blind hole disposed concentrically within said circular portion;

said locking pin means extends between said screw means and said blind hole of said circular portion;

said bottom portion further comprises a plurality of projecting portions;

said plurality of projecting portions project outwardly from said bottom portion;

said internal surface of said outer core and said plurality of webs and said inner core define a plurality of spaces within said center cylinder;

said plurality of projecting portions are disposed within corresponding ones of said plurality of spaces within said center cylinder;

said twist tube comprises:

locking ring means;

a groove disposed about the external surface of said twist tube;

said locking ring means is disposed in said groove of said twist tube;

said locking ring means comprises a part-circular shape;

said drum further comprises attaching means for attaching said top and bottom portions to said center cylinder;

said center cylinder comprises means for receiving said attaching means;

said receiving means of said center cylinder being disposed about the circumference of said internal surface of said outer core;

said attaching means comprises a plurality of screws; and said tensioning means is disposed radially inward from said slot means.

* * * * *

UNITED STATES PATENT AND TRADEMARK OFFICE

CERTIFICATE OF CORRECTION

PATENT NO. : 5,439,410
DATED : August 8, 1995
INVENTOR(S) : Svante LARSSON

It is certified that error appears in the above-indentified patent and that said Letters Patent is hereby corrected as shown below:

On title page, item [56], after the 950,527 entry, insert the following U.S. and Foreign Patent Document information:

--1,302,724 6/1919 Solem
1,721,172 7/1929 Becker
1,885,123 11/1932 Mattison

FOREIGN PATENT DOCUMENTS 91,655 3/1938 Sweden--.

In column 3, line 62, after the first occurrence of 'The', delete "extend" and insert --extent--.

Signed and Sealed this

Twelfth Day of November, 1996

*Attest:*

BRUCE LEHMAN

*Attesting Officer*

*Commissioner of Patents and Trademarks*